United States Patent [19]

Bresson

[11] Patent Number: 4,877,518

[45] Date of Patent: Oct. 31, 1989

[54] ORE FLOTATION EMPLOYING DIMERCAPTOTHIADIAZOLES

[75] Inventor: Clarence R. Bresson, Bartlesville, Okla.

[73] Assignee: Phillips Petroleum Company, Bartlesville, Okla.

[21] Appl. No.: 189,458

[22] Filed: May 2, 1988

[51] Int. Cl.[4] ..... B03D 1/02

[52] U.S. Cl. ..... 209/167; 252/61

[58] Field of Search ..... 209/166, 167; 252/61

[56] References Cited

U.S. PATENT DOCUMENTS

| | | | |
|---|---|---|---|
| 1,807,860 | 6/1931 | Moses | 209/166 |
| 1,825,501 | 9/1931 | Bursky | 209/166 |
| 1,852,108 | 4/1932 | Christman | 209/166 |
| 1,894,344 | 1/1933 | Christman | 209/166 |
| 3,449,365 | 6/1969 | Lies | 260/327 |
| 3,469,692 | 9/1969 | Freyberger | 209/166 |
| 3,494,758 | 2/1970 | Kopp | 71/67 |
| 3,784,454 | 1/1974 | Lyde | 204/52 R |
| 4,022,686 | 5/1977 | Arakatsu | 209/166 |
| 4,107,168 | 8/1978 | Okorodudu | 260/302 E |
| 4,357,396 | 11/1982 | Grunewalder | 428/626 |

FOREIGN PATENT DOCUMENTS

| | | | |
|---|---|---|---|
| 314822 | 7/1929 | United Kingdom | 209/166 |

OTHER PUBLICATIONS

Chemical Abstracts, vol. 86: 30341e (1977), p. 20.

*Primary Examiner*—Kenneth M. Schor
*Assistant Examiner*—Thomas M. Lithgow
*Attorney, Agent, or Firm*—H. B. Woodrow

[57] ABSTRACT

A process for separating and recovering minerals, such as molybdenum or coal, from ores with which they occur by addition of a dimercaptothiadiazole to an ore flotation process.

23 Claims, No Drawings

ORE FLOTATION EMPLOYING DIMERCAPTOTHIADIAZOLES

BACKGROUND OF INVENTION

The present invention relates generally to flotation processes for recovering desired minerals from ores containing those minerals. In another aspect, this invention relates to a process wherein sulfide minerals are separated from other sulfide minerals with which they occur by addition of a dimercaptothiadiazole to an ore flotation process.

Flotation processes are known in the art and are used for concentrating and recovering minerals from ores. In froth flotation processes, the ore is crushed and wet ground to obtain a pulp. Additives such as mineral flotation or collecting agents, frothers, depressants, and stabilizers are added to the pulp to assist separating valuable materials from undesirable or gangue portions of the ore in subsequent flotation steps. The pump is then aerated to produce a froth. The minerals which adhere to the bubbles or froth are skimmed or otherwise removed and the mineral bearing froth is collected and further processed to obtain the desired minerals. Typical mineral flotation collectors include xanthates, amines, alkyl sulfates, arene sulfonates, dithiocarbamates, dithiophosphates, and thiols. Frequently, other chemicals are added to the separated mineral-bearing forth to assist in subsequent separations particularly when significant proportions of two or more minerals are present in the separated mineral-bearing froth. Such chemicals are known as depressants. These materials are used to selectively separate one type of mineral from another type of mineral.

While the art of ore flotation has reached a significant degree of sophistication, it is a continuing goal in the ore recovery industry to increase the productivity of ore flotation processes and above all to provide specific processes which are selective to one ore or to provide specific processes which are selective to one mineral over other minerals which are present in the treated material.

SUMMARY OF THE INVENTION

It is the object of the present invention to provide an improved process for recovering desired minerals from ores containing such minerals.

It is also the object of this invention to provide a process for recovery of molybdenum from ores in which it occurs.

It is another object of this invention to provide a process for recovery of coal from other minerals with which it occurs.

It is still another object of this invention to provide a process for recovery of molybdenum from the metallurgical concentrates in which it occurs.

In accordance with this invention, it has now been found that dimercaptothiadiazoles are very effective in the recovery of desired minerals from ores containing those minerals in ore flotation processes. In one embodiment of this invention, a process is provided for the recovery of molybdenum from the ore in which it occurs by the addition of a dimercaptothiadiazole in an ore flotation process.

In a second embodiment of this invention, a process is provided for the recovery of coal from other minerals with which it occurs by the addition of a dimercaptothiadiazole in an ore flotation process.

In a third embodiment of this invention, a process is provided for the recovery of molybdenum from a metallurgical concentrate obtained in a first flotation step by the addition of a dimercaptothiadiazole in subsequent flotation steps in a flotation process.

DETAILED DESCRIPTION OF THE INVENTION

In accordance with the present invention, there is provided a process for recovering at least one desired mineral from a mineral ore containing the at least one desired mineral. The ore flotation process of this invention distinguishes over the known ore flotation processes primarily in the employment of a new treating agent to be defined. The flotation process comprises carrying out a mineral flotation with a treating agent present, wherein the treating agent is a dimercaptothiadiazole having the formula:

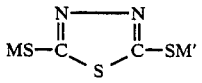

wherein M and M' are selected from the group consisting of hydrogen and alkali metal atoms.

Generally, the flotation process will utilize a composition comprising the dimercaptothiadiazole, water, and the mineral material. The treating agent of the present invention can be used to suppress iron sulfides, copper sulfides and/or lead sulfides in the presence of molybdenum. The recovery of other mineral sulfides, such as those based on Zn, Ni, Sb, etc., are considered within the scope of this invention. The treating agent of the invention is also effective to suppress sulfides in the presence of coal, and thus also has utility in coal beneficiation. In ores, the metals are usually in a solid sulfided state and form a slurry, which can be finely divided, as in a pulp. For example, the invention can be employed to process an ore slurry containing high copper values. The invention can also be employed to process a concentrate, such as a concentrate which contains high molybdenum values. Exemplary ores include the following:

| | |
|---|---|
| Molybdenum-Bearing Ores | |
| Molybdenum | $MoS_2$ |
| Wulfenite | $PbMoO_4$ |
| Powellite | $Ca(MO,W)O_4$ |
| Ferrimolybdite | $Fe_2Mo_3O_{12}.8H_2O$ |
| Copper-Bearing Ores | |
| Covallite | CuS |
| Chalcocite | $Cu_2S$ |
| Chalcopyrite | $CuFeS_2$ |
| Bornite | $Cu_5FeS_4$ |
| Cubanite | $Cu_2SFe_4S_5$ |
| Valerite | $Cu_2Fe_4S_7$ or $CU_3Fe_4S_7$ |
| Enargite | $Cu_3(As,Sb)S_4$ |
| Tetrahedrite | $Cu_3SbS_2$ |
| Tennanite | $Cu_{12}As_4S$ |
| Stannite | $Cu_2S.FeS.SnS_2$ |
| Bournonite | $PbCuSbS_3$ |
| Leading-Bearing Ore: | |
| Galena | PbS |
| Antimony-Bearing Ore: | |
| Stibnite | $Sb_2S_3$ |
| Kermesite | $Sb_2S_2O$ |
| Zinc-Bearing Ore: | |
| Sphalerite | Zns |

-continued

| | |
|---|---|
| Silver-Bearing Ore: | |
| Argentite | $Ag_2S$ |
| Stephanite | $Ag_5SbS_4$ |
| Polybasite | $9Ag_2S.Sb_2S_3$ |
| Iron-Bearing Ore: | |
| Pyrite | $FeS_2$ |
| Pyrrohotite | $Fe_5S_6$ to $Fe_{16}S_{17}$ |
| Arsenopyrite | FeAsS |
| Marmatite | (ZnFe)S |
| Nickel-Bearing Ore: | |
| Millerite | NiS |
| Pentlandite | (FeNi)S |
| Ullmannite | NiSbS |

Generally, the solids to be processed will be present as a slurry in water which contains the treating agent, with the treating agent being present in an amount of about 0.01 to about 20 pounds per ton of the solids. The slurry usually contains between about 10 and 75 percent solids preferably in the range of 15–60 weight percent solids, depending on the processing stage. Preferably, the dimercaptothiadiazole is present in the composition in an amount in the range of about 0.1 to about 3 pounds per ton of solids. Even more preferably, the dimercaptothiadiazole is present in an amount in the range of about 0.4 to about 2 pounds per ton of the solids. The preferred dimercaptothiadiazole is 2,5-dimercapto-1,3,4-thiadiazole, disodium salt. The flotation process usually involves the steps of:

(a) mixing crushed or ground mineral material with water and the treating agent defined above to establish a pulp, (b) aerating the pulp to produce a froth and a pulp, (c) separating the froth from the pulp and producing a concentrate product and a tail product, and (d) recovering minerals from the so separated concentrate and/or tail product.

Recovery after additional flotation and frothing steps is optional. In the method of the present invention, the treating agent may be added to the concentrate obtained from a first flotation step and the concentrate then subjected to a subsequent flotation step. The desired minerals may then be recovered from the resulting concentrate and/or tail.

Mineral flotation or collecting agents, frothers, and stabilizers can also be used in the various steps.

The inventive depressant can be used together with other depressants or depression steps is desired. For example, the depressant composition defined above can be used with additional depressants, such as sodium cyanide, sodium ferrocyanide, and lime in the treatment of an ore.

Any froth flotation apparatus can be used in this invention. The most commonly used commercial flotation machines are the Agitair (Galigher Co.), Denver D-12 (Denver Equipment Co.), and the Fagergren (Western Machinery Co.).

The instant invention was demonstrated in tests conducted at ambient room temperature and atmospheric pressure. However, any temperature or pressure generally employed by those skilled in the art is within the scope of this invention.

EXAMPLE I

This example shows the effectiveness of 2,5-dimercapto-1, 3,4-thiadiazole, disodium salt (NATD) as a mineral sulfide depressant in comparison with other depressant compositions at various concentrations. In a table-top ball mill, 1000g of a molybdenum bearing ore (Questa Mine), 660 ml waster, 0.1 ml oil (Molybdenum Corporation), and 14 drops from a 26 gage needle of a frother (Methyl Isobutyl Carbinol: Pine Oil, 6:3) were ground for 6 minutes 42 seconds to obtain a 60% solids pulp. The pulp was conditioned for 0.5 minutes at 1500 rpm and floated 8 minutes at a pH of 8.2 in a Wemco Glass 2.5 liter cell. The resulting concentrate from this first flotation step (rougher float) was added to a Denver D-12, 1.6 liter cell wih the depressant to be tested. All depressants were added as freshly made 1% solutions by mixing 97.5g $H_2$, 2 NaOH pellets and 2.5 g of 40% depressant solution. The mixture was adjusted to a pH of 8.5 and conditioned 2 minutes at 1100 rpm. To the mixture was added 1 drop of oil and 2 drops of the frother. The mixture was then conditioned 0.5 minutes at 1100 rpm and floated 4 minutes (cleaner float). The percent average recovery of molybdenum, copper, iron, and lead from the cleaner float are shown in Table I.

TABLE I

Effect of 2,5-dimercapto-1,3,4, thiadiazole, disodium salt as a Cu, Pb, and Fe Depressant in Mo Ore Flotation

| Reagent | Concentration lb/ton* | Percent Average Recovery Cu | Pb | Fe | Mo |
|---|---|---|---|---|---|
| No depressant | — | 76.3 | 74.4 | 11.3 | 87.8 |
| Orform ® D8[a] | 0.4 | 17.2 | 27.8 | 10.7 | 83.4 |
| Orform ® D8 | 0.8 | 17.8 | 29.5 | 8.5 | 76.7 |
| Orform ® D8 | 1.6 | 12.9 | 27.8 | 7.4 | 75.0 |
| Orform ® D22[b] | 0.4 | 16.0 | 30.0 | 8.0 | 86.6 |
| Orform ® D22 | 0.8 | 20.7 | 30.0 | 9.1 | 87.6 |
| Orform ® D22 | 1.6 | 20.2 | 26.4 | 10.4 | 87.2 |
| TNNBD[c] | 0.4 | 46.9 | 43.4 | 10.9 | 88.3 |
| TNNBD | 0.8 | 32.9 | 51.0 | 9.4 | 88.2 |
| TNNBD | 1.6 | 32.9 | 49.1 | 9.0 | 86.5 |
| SNNP[d] | 0.4 | 16.7 | 45.5 | 8.3 | 86.5 |
| SNNP | 0.8 | 20.6 | 60.2 | 10.2 | 85.5 |
| SNNP | 1.6 | 21.7 | 62.2 | 7.5 | 84.7 |
| NATD[e] | 0.4 | 25.0 | 66.6 | 8.9 | 85.1 |
| NATD | 0.8 | 18.5 | 62.5 | 7.6 | 85.1 |
| NATD | 1.6 | 17.2 | 58.5 | 8.0 | 84.4 |

*pounds of contained chemical per ton of ore or concentrate (0.4 lb/ton = 1.0 lb/ton of 40% solution)

[a]40% disodium carboxymethyl trithiocarbonate

[b]40% disodium carboxymethyl dithiocarbamate

[c]40% trisodium N,N—bis (carboxymethyl) dithiocarbamate

[d]40% sodium, N,N—diethyl-2-aminoethyl (3-thiocarbonyldithio) propionate

[e]40% 2,5-dimercapto-1,3,4-thiadiazole, disodium salt

As can be seen from Table 1, NATD effectively suppresses Cu, Fe, and Pb and compares favorably with known suppressant compositions.

EXAMPLE II

This example compares the effectiveness of 2,5-dimercapto-1, 3,4-thiadiazole, disodium salt in three different molybdenum bearing ores. The Questa Mine ore was prepared as described in Example I. The other two ores were prepared similarly. All ores were ground in a table-top ball mill with water, oil, frother, and lime, if needed to adjust pH, to form pulps. Flotation and frothing agents were added to the pulps and the pulps were subjected to a rougher flotation step in a 2.5 liter cell. The depressant was added to the resulting concentrates and the concentrates were subjected to a cleaner flotation step 1 a 1.6 liter cell.

The percent recovery of Mo, Cu, Fe, and Pb from the concentrate of each ore is shown in Table II.

TABLE II

Effect of 2,5-Dimercapto-1,3,4-Thiadiazole, Disodium Salt (NATD) as a Cu, Fe, and Pb Depressant in Mo Bearing Ores

| | % Head** | | | | Conc. NATD | Percent Average Recovery | | | |
|---|---|---|---|---|---|---|---|---|---|
| Source* | Mo | Cu | Fe | Pb | lb/ton*** | Mo | Cu | Fe | Pb |
| Pinto Valley | 0.2 | 8.0 | 16 | .01 | — | 90.0 | 93.5 | 89.4 | 56.0 |
| Pinto Valley | | | | | 0.8 | 61.7 | 11.8 | 8.5 | 22.1 |
| Questa | 1.2 | 0.1 | 3.1 | .03 | — | 87.8 | 76.3 | 11.3 | 74.4 |
| Questa | | | | | 0.4 | 85.1 | 25.0 | 8.9 | 66.6 |
| Questa | | | | | 0.8 | 85.1 | 18.5 | 7.6 | 62.5 |
| Questa | | | | | 1.6 | 84.4 | 17.2 | 8.0 | 58.5 |
| Butte | 0.9 | 8.0 | 2.2 | .01 | — | 98.3 | 96.5 | 93.7 | 80.3 |
| Butte | | | | | 0.8 | 74.1 | 23.9 | 43.3 | 33.4 |
| Butte | | | | | 1.6 | 77.0 | 23.5 | 44.4 | 31.3 |

*all sources are rougher concentrates
**percent of rougher concentrate
***pounds of contained chemical per ton of ore or concentrate As can be seen in Table II, NATD has good selectivity for copper and iron depression over molybdenum, irrespective of the initial molybdenum concentration or high iron content. Depression of lead is also apparent.

While this invention has been described in detail for the purpose of illustration, it is not to be construed as limited thereby but is intended to cover all changes and modifications thereof.

That which is claimed is:

1. A process for recovery of minerals comprising:

(a) mixing crushed ore containing said minerals, water, and a sufficient amount of a dimercaptothiadiazole to depress a first portion of said minerals, said dimercaptothiadiazole having the formula:

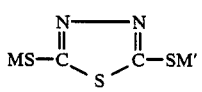

wherein M and M′ are selected from the group consisting of hydrogen and alkali metal atoms, to establish a pulp;

(b) aerating said pulp to produce a froth and a resultant pulp, said froth containing a second portion of said minerals while allowing said first portion of said minerals to be depressed in said resultant pulp; and (c) recovering said second portion of said minerals from said froth.

2. A process according to claim 1 wherein M and M′ are hydrogen.

3. A process according to claim 1 wherein M and M′ are sodium.

4. A process according to claim 1 wherein the amount of the dimercaptothiadiazole employed is within the range from about 0.01 to about 20 lb/ton of ore.

5. A process according to claim 1 wherein the amount of the dimercaptothiadiazole employed is within the range from about 0.1 to about 3 lb/ton of ore.

6. A process according to claim 1 wherein the amount of the dimercaptothiadiazole employed is within the range from about 0.4 to about 2 lb/ton of ore.

7. A process according to claim 1 wherein said second portion of said minerals comprises a molybdenum compound.

8. A process according to claim 1 wherein said second portion of said minerals comprises coal.

9. A process according to claim 1 wherein said first portion of said minerals comprises one or more minerals selected from the group consisting of copper sulfide, lead sulfide, and iron sulfide minerals.

10. A process for the recovery of molybdenum comprising:

(a) mixing crushed ore containing a molybdenum compound and at least one mineral selected from the group consisting of copper sulfide, lead sulfide, and iron sulfide, water, and 2,5-dimercapto-1,3,4-thiadiazole, disodium salt in the amount from about 0.4 to about 2 lb/ton of crushed ore to establish a pulp;

(b) aerating said pulp to produce a froth and a resultant pulp, said froth containing a molybdenum compound while allowing said at least one mineral selected from the group consisting of copper sulfide, lead sulfide, and iron sulfide to be depressed in said resultant pulp; and (c) recovering said molybdenum compound from said froth.

11. A process for the recovery of minerals comprising:

(a) mixing crushed ore containing said minerals and water to establish a pulp;

(b) subjecting said pulp to flotation wherein said pulp is aerated to produce a froth containing concentrated minerals;

(c) recovering said froth and converting said froth into a subsequent pulp containing said concentrated minerals;

(d) contacting said subsequent pulp with a sufficient amount of a dimercaptothiadiazole to depress a first portion of said concentrated minerals present in said subsequent pulp, said dimercaptothiadiazole having the formula:

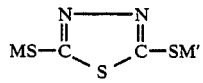

wherein M and M′ are selected from the group consisting of hydrogen and alkali metal atoms;

(e) aerating said subsequent pulp contacted with dimercaptothiadiazole to produce a resultant pulp and a subsequent froth, said subsequent froth containing a second portion of said concentrated minerals while allowing said first portion of said concentrated minerals to be depressed in said resultant pump, and;

(f) recovering said second portion of said concentrated minerals from said subsequent froth.

12. A process according to claim 11 wherein M and M' are hydrogen.

13. A process according to claim 11 wherein M and M' are sodium.

14. A process according to claim 11 wherein the amount of the dimercaptothiadiazole employed is within the range from about 0.01 to about 20 lb/ton of concentrate.

15. A process according to claim 11 wherein the amount of the dimercaptothiadiazole employed is with the range from about 0.1 to about 3 lb/ton of concentrate.

16. A process according to claim 11 wherein the amount of the imercaptothiadiazole employed is within the range from about 0.4 to about 2 lb/ton of concentrate.

17. A process according to claim 11 wherein said second portion of said concentrated minerals comprises a molybdenum compound.

18. A process according to claim 11 wherein said second portion of said concentrated minerals comprises coal.

19. A process according to claim 11 wherein said first potion of said concentrated minerals comprises one or more minerals selected from the group consisting of copper sulfide, lead sulfide, and iron sulfide minerals.

20. A process according to claim 11 wherein:

(a) said concentrated minerals contains a molybdenum compound and at least one mineral selected from the group consisting of copper sulfide, lead sulfide, and iron sulfide;

(b) said dimercaptothiadiazole is 2,5-dimercapto-1,3,4-thiadiazole, disodium salt and is introduced in an amount of about 0.4 to about 2 lb/ton of concentrate;

(c) said second portion contains said molybdenum compound while said at least one mineral selected from the group consisting of copper sulfide, lead sulfide, and iron sulfide are suppressed in said resultant pump; and (d) said molybdenum compound is recovered from said subsequent froth containing said second portion of said concentrated minerals and said first portion of said concentrated minerals are recovered from said resultant pulp.

21. A process according to claim 1 wherein said first portion of said minerals is recovered from said resultant pulp.

22. A process according to claim 10 wherein said at least one mineral selected from the group consisting of copper sulfide, lead sulfide, and iron sulfide is recovered from said resultant pulp.

23. A process according to claim 11 wherein said first portion of said concentrated minerals is recovered from said resultant pulp.

* * * * *